United States Patent [19]

Madono

[11] Patent Number: 4,584,328

[45] Date of Patent: Apr. 22, 1986

[54] METHOD OF ACCELERATING THE BREAKDOWN OF PHENOLIC RESIN BONDED CORES

[76] Inventor: Osamu Madono, 22-3 Ohto 5-chome, Yono-shi, Saitama-ken, Japan

[21] Appl. No.: 541,233

[22] Filed: Oct. 12, 1983

[30] Foreign Application Priority Data

Oct. 14, 1982 [JP] Japan ..... 57-179117

[51] Int. Cl.[4] ..... B22C 11/22

[52] U.S. Cl. ..... 523/145; 164/526; 164/527; 523/146

[58] Field of Search ..... 523/145, 146; 164/526, 164/527

[56] References Cited

U.S. PATENT DOCUMENTS

| | | | |
|---|---|---|---|
| 3,666,703 | 5/1972 | Murata et al. | 523/145 |
| 4,459,376 | 7/1984 | Matsushima et al. | 523/145 |
| 4,468,486 | 8/1984 | Matsushima et al. | 523/146 |

*Primary Examiner*—Lorenzo B. Hayes

*Attorney, Agent, or Firm*—Burns, Doane, Swecker and Mathis

[57] ABSTRACT

A method of accelerating the breakdown of phenolic resin bonded cores by means of adding a basic salt of alkali metals in powder form to phenolic resin coated sand is disclosed. The basic salt is selected from the group consisting of alkali metal carbonates, bicarbonates and organic acid salts, and mixtures thereof, and is microcapsulated with plastic.

6 Claims, No Drawings

METHOD OF ACCELERATING THE BREAKDOWN OF PHENOLIC RESIN BONDED CORES

BACKGROUND OF THE INVENTION

1. Field of the Invention

This invention relates to a method of accelerating the breakdown of phenolic resin bonded cores and to additive compositions for its acceleration.

2. Description of the Prior Art

Cores bonded with phenolic resin have been widely used in foundries of metals ranging from steel to aluminum. However, in some cases such as aluminum casting, this type of core has the difficult problem that it fails in breakdown capability This is due to the fact that the melting temperature of aluminum is too low to promote the thermal decomposition of phenolic resin during its casting. In addition, there are other causes which are characteristic of aluminum casting and which worsen the problem.

Phenolic resin is heat resistant and undergoes thermal decomposition only when it is heated above 500° C. Hence, cores bonded with the resin fail in breakdown capability in aluminum castings whose melting temperature is too low to heat them up to the critical temperature. In most aluminum casting methods, pouring is at around 700° C. and the temperature to which cores are heated is estimated to be below 500° C. For shaking out cores completely, it is often necessary to reheat castings in a furnace above 500° C. for several hours. Naturally, this results not only in excessive man-hours but also in high fuel costs.

To improve the breakdown property of phenolic resin bonded cores, various solutions have been proposed. For example, various derivatives of phenolic resin having a lower thermal decomposition temperature are used for core making. However, cores thus made bring about another undesirable result in aluminum castings. That is, since thermal decomposition of resin is always accompanied by gas evolution, it tends to cause blow holes in castings. In particular, there is a tendency that the lower the thermal decomposition temperature of the resin is, the more marked is the production of blow holes are caused.

SUMMARY OF THE INVENTION

It is the object of the present invention to improve the breakdown properties of phenolic resin bonded cores.

The inventor of this invention has found that this object is achieved by adding a breakdown accelerator to core sand which is coated with a conventional phenolic resin. The accelerator which the inventor found contains alkali metal compounds such as carbonates, bicarbonates, or organic acid salts, and has the form of a fine powder. Core sand mixed with the accelerator is formed in the usual way, i.e. by blowing it into a core box.

Thus, this invention resides in a method of accelerating the breakdown of phenolic resin bonded cores by means of adding basic salts of alkali metals in powder form to phenolic resin coated sand, wherein the basic salts are selected from the group consisting of alkali metal carbonates, bicarbonates, organic acid salts, and mixtures thereof.

The phenolic resin coated sand employed in this invention may be the conventional one.

According to this invention, as an accelerator for decomposition of phenolic resin, alkali metal carbonates such as sodium carbonate, potassium carbonate, etc., alkali metal bicarbonates such as sodium bicarbonate, and the organic acid salts of alkali metals such as tartrates, citrates, acetates, and oxalates of alkali metals may be used. These compounds will be referred to as "alkali metal compounds" or "basic salts of alkali metals" collectively hereunder. The use of sodium carbonate is preferred.

The accelerator of this invention, i.e. the basic salts of alkali metals in powder form may be microencapsulated with plastic.

This invention also resides in an additive composition for use in accelerating the breakdown of phenolic resin bonded cores, the additive composition comprising basic salts of alkali metals in powder form, and which is microencapsulated with plastic.

DESCRIPTION OF THE PREFERRED EMBODIMENTS

The above-mentioned alkali metal compounds have the excellent property of promoting the thermal decomposition of phenolic resin. However, they have the disadvantage that their addition to the core sand results in lowering the baked strength of cores thus made. Another disadvantage is that they become moist easily, and if they become wet, their addition to core sand results not only in a reduction in the baked strength of cores but also in an increase in casting defects caused due to gas blowing.

To eliminate these disadvantages successfully, the alkali metal compounds of this invention may be microencapsulated with plastic. To do so, powder of the compounds is mixed with a plastic solution or colloidal solution and then dried up. The plastic usable for this microencapsulation include polystyrene, polymethacrylate, and polyvinyl. They are thermoplastic and undergo thermal decomposition when they are heated above about 300° C.

The plastic microencapsulated alkali metal compounds have the following advantages:

(1) They scarcely become moist even after they are heated at the high temperatures of core baking;

(2) Since plastic wets phenolic resin well, it improves the baked strength of cores;

(3) On pouring molten metal, the plastic capsule decomposes and then the alkali metal compounds react directly with phenolic binder. Therefore, it does not disturb the alkali metal compounds in their accelerating the breakdown of cores.

The amount of the accelerator to be added to core sand is less than 2% by weight. The amount should be varied in accordance not only with the content of the phenolic resin used for coating but also in accordance with the grain size of the sand.

The method of producing the breakdown accelerator and core sand according to this invention will be described in conjunction with the following examples, which are presented as specific illustrations of the claimed invention. It should be understood, however, that the invention is not limited to the specific details set forth in the examples.

EXAMPLE 1

One part by weight of sodium carbonate was mixed with two parts by weight of potassium bitartrate. The mixture was added to a 20% polystyrene solution and thoroughly kneaded to produce a paste mixture. Subsequently, kerosene was added to the paste for microencapsulation by means of coacervation. The paste was dried and reduced to a powder. The powder did not become moist and could be stored for long periods.

EXAMPLE 2

One part of sodium carbonate was mixed with 5 parts of polystyrene colloidal solution whose solvent was a mixture of xylene and kerosene. The colloidal solution had a composition of 10% of polystyrene, 30% solvent and 60% ceramic powder. The resulting paste was warmed to remove xylene and reduced to a powder.

In core making one part by weight of the powder prepared in Example 1 or 2 was mixed with 100 parts by weight of the conventional phenolic resin coated sand whose resin content was 2% by weight. The addition of the powder to the sand had no detrimental effect upon the baked properties of the resulting cores. They had a bending strength of higher than 40 kg/cm$^2$ and there were few differences in the performance of the thus prepared cores and the conventional cores made without the additive.

EXAMPLE 3

In this example, cores prepared in accordance with Examples 1 and 2 above were used for aluminum castings of cylinder heads and intake manifolds. On casting no casting defects were produced by gas evolution. Their breakdown property was excellent, and thus the core sand prepared in accordance with this invention was able to be easily shaken out by mechanical vibration. By contrast, it is necessary to reheat castings above 500° C. for several hours to remove cores unless prepared with the addition of the breakdown accelerator according to this invention.

EXAMPLE 4

One part by weight of potassium bitartrate was mixed with 100 parts by weight of resin coated sand having a content of 2% by weight phenolic resin. Cores made from this sand had excellent breakdown capability in aluminum casting. However, they had the disadvantage that their baked bending strength was less than 20 kg/cm$^2$, and that they were too weak to make cores of delicate design.

EXAMPLE 5

One part by weight of potassium carbonate was mixed with 300 parts by weight of resin coated sand having a content of 2% by weight of phenolic resin. Cores thus made had excellent breakdown capability in aluminum castings. However, they had the disadvantage that since they easily became moist, it was difficult to store them for long.

Although this invention has been described with preferred embodiments it is to be understood that variations and modifications may be employed without departing from the concept of the invention as defined in the following claims.

What is claimed is:

1. A method of accelerating the breakdown of phenolic resin bonded cores by means of adding a basic salt of alkali metals in powder form to phenolic resin coated sand, wherein the basic salt is selected from the group consisting of alkali metal carbonates, bicarbonates and organic acid salts, and mixtures thereof and wherein the basic salt powder is microencapsulated with a thermoplastic polymer.

2. The method defined in claim 1, wherein said basic salt of alkali metals is selected from the group consisting of sodium carbonate, potassium carbonate, sodium bicarbonate, potassium bicarbonate, sodium tartrate, potassium tartrate, postassium bitartrate, sodium citrate, potassium citrate, sodium acetate, potassium acetate, sodium oxalate, potassium oxalate, and mixtures thereof

3. The method defined in claim 2, wherein said basic salt of alkali metals is sodium carbonate.

4. The method defined in claim 1, wherein the thermoplastic polymer is selected from the group consisting of polystyrene, polymethacrylate, and mixtures thereof.

5. The method defined in claim 1, wherein the thermoplastic polymer is polystyrene.

6. A method of accelerating the breakdown of phenolic resin bonded cores comprising the step of adding a substantially dry basic salt of alkali metals in powder form to a phenolic resin coated sand, wherein the basic salt is selected from the group consisting of alkali metal carbonates, bicarbonates and organic acid salts, and mixtures thereof and wherein the basic salt powder is microencapsulated with a thermoplastic polymer.

* * * * *